United States Patent [19]

Schulke et al.

[11] Patent Number: 4,606,804

[45] Date of Patent: Aug. 19, 1986

[54] ELECTRODE

[75] Inventors: Dwight A. Schulke, Edmond, Okla.; Everette M. Spore, Henderson, Nev.

[73] Assignee: Kerr-McGee Chemical Corporation, Oklahoma City, Okla.

[21] Appl. No.: 681,110

[22] Filed: Dec. 12, 1984

[51] Int. Cl.[4] ..... C25B 11/02; C25B 11/10

[52] U.S. Cl. ..... 204/286; 204/290 F; 204/292; 204/293

[58] Field of Search ..... 204/288, 289, 290 R, 204/290 F, 286, 292–293

[56] References Cited

U.S. PATENT DOCUMENTS 1,836,368 12/1931 Eppensteiner et al. ..... 204/286 X
4,319,977 3/1982 Wortley ..... 204/280
4,380,493 4/1983 Wortley et al. ..... 204/289 X
4,391,695 7/1983 Koziol et al. ..... 204/288 X
4,460,450 7/1984 Koziol et al. ..... 204/290 F

*Primary Examiner*—Donald R. Valentine
*Attorney, Agent, or Firm*—William G. Addison; John P. Ward

[57] ABSTRACT

An electrode assembly, having improved dimensional stability, for use in the electrolytic production of manganese dioxide and comprising a hanger bar member, at least one corrugated panel member having oppositely opposed upper and lower ends, said at least one panel member being fixedly attached to said hanger bar member at the upper end of said at least one panel member and a stiffening bar member fixedly attached to said lower end of said at least one corrugated panel member.

8 Claims, 4 Drawing Figures

ELECTRODE

FIELD OF THE INVENTION

This invention relates to electrode assemblies and particularly to electrode assemblies having improved dimensional stability for use in the electrolytic production of manganese dioxide. More particularly, the invention relates to electrode assemblies of titanium having improved dimensional stability.

BACKGROUND OF THE INVENTION

The use or desirability of using titanium electrodes in electrolytic processes for the extraction of metals and metal oxides is well known. See, for example, U.S. Pat. Nos. 4,319,977 and 4,460,450. This use or desirability of using electrodes constructed of titanium is based on a number of advantages offered by titanium over other materials that have been employed in such electrode structures in the past. Of the numerous advantages provided by the use of titanium electrodes, the most noteworthy are their durability, low corrosiveness and the improved quality of the metal or metal oxide deposits recovered therefrom on a long-term basis.

However, according to U.S. Pat. No. 4,319,977, a major drawback to the use of such titanium electrodes is their cost, titanium being an expensive metal. Thus, in the above patent, it is disclosed that much effort has been expended in developing electrodes, based on titanium, of reduced cost but without sacrificing the advantages associated with the use of titanium. One such development disclosed in the above patent comprises an electrode of a sandwich-type construction in which a core metal having good electrical conductivity is coated with titanium on both sides. Such sandwich-type construction reduces the cost of the electrode while retaining all of the advantages afforded by titanium.

Another development disclosed in the above patent comprises an electrode utilizing corrugated sheets of titanium. According to the above patent, the conventional thickness of titanium electrodes is on the order of about 4 mm. The use of corrugated sheets of titanium as electrodes presumably allows the use of thinner sheets of the titanium metal thereby reducing the overall costs of the electrode while retaining the rigidity associated with titanium electrodes constructed of thicker sheets of the metal. However, the reduction in thickness afforded by corrugating sheets is said to be very small and hardly pays for the cost of corrugation. The disclosure in U.S. Pat. No. 4,319,977 concludes that, overall, simple (i.e., single) corrugated sheets of titanium have not proven to be economically viable and particularly in the thicknesses desired.

The invention in the above referenced patent itself is directed to an improved electrode for use in the electrolytic production of manganese dioxide. the electrode disclosed in the referenced patent comprises two continuous sheets of a metal, e.g., titanium, joined in a face-to-face relationship. At least one of said sheets is corrugated so as to provide rigidity to the electrode. In turn, the two joined sheets are attached to a hanger bar by means of a series of straps machined into the sheets.

Another patent disclosing the use of corrugated sheets of metals such as titanium in electrode assemblies is U.S. Pat. No. 4,460,450. In general, the disclosure in this patent relates to the providing of an electrode having current-carrying components which provide good electrically conductive connections between a core metal and the jacket metal of said current-carrying components.

SUMMARY OF THE INVENTION

In accordance with the present invention, there is provided an electrode assembly having improved dimensional stability for use in the electrolytic manufacture of manganese dioxide. The improved electrode assembly comprises a hanger bar member, at least one corrugated panel member fixedly attached to said hanger bar member at one end of said at least one corrugated panel member and a stiffening bar member fixedly attached to said at least one corrugated panel member at the end thereof opposite said hanger bar member.

The hanger bar member which has a longitudinal dimension and oppositely opposed ends is comprised of a solid core of an electrically conductive metal and a cladding thereon of a lesser electrically conductive and more corrosion resistant metal. The hanger bar member further is characterized as having a pair of engaging means. Each of said engaging means of said pair of engaging means is laterally disposed to the longitudinal dimension of said hanger bar member and spacially arranged inwardly from he oppositely opposed ends of said hanger bar member. At least one of said engaging means of said pair of engaging means provides for contact between the hanger bar member and an electric current-carrying bus bar.

The at least one corrugated panel member of the electrode assembly comprises a single corrugated sheet having oppositely opposed upper and lower ends and, in general, will be constructed of the same lesser electrically conductive and more corrosion resistant metal as the metal cladding of the hanger bar member. This at least one corrugated panel member will be fixedly attached, at the upper end thereof, to the hanger bar members. The attachment of the corrugated panel member to the hanger bar member will be such that the corrugated panel member is located in a position perpendicular to the longitudinal dimension of said hanger bar member and between each of the engaging means of the pair of engaging means of said hanger bar member.

In general, attachment of the corrugated panel member to said hanger bar member will be effected by the use of penetrating welds. These penetrating welds will be applied on both sides of the corrugated panel member and along the exposed junctures or lines formed at the point of direct contact between the corrugated panel member and the hanger bar member along the longitudinal dimension of said hanger bar member.

The stiffening bar member is fixedly attached to the oppositely opposed lower end of said corrugated panel member in a manner to provide direct contact between said stiffening bar member and said corrugated panel member. Preferably, the means employed for effecting this direct attachment will be the same as that employed for fixedly attaching the corrugated panel member, at its upper, oppositely opposed end, to the hanger bar member. Thus, the stiffening bar member is attached to the corrugated panel member through the use of penetrating welds along both sides of the corrugated panel member. Again, such penetrating welds will be located along the exposed junctures or lines formed at the point of direct contact between the panel member and the stiffening bar member along the longitudinal dimension thereof.

DETAILED DESCRIPTION OF THE INVENTION

Figure 1:
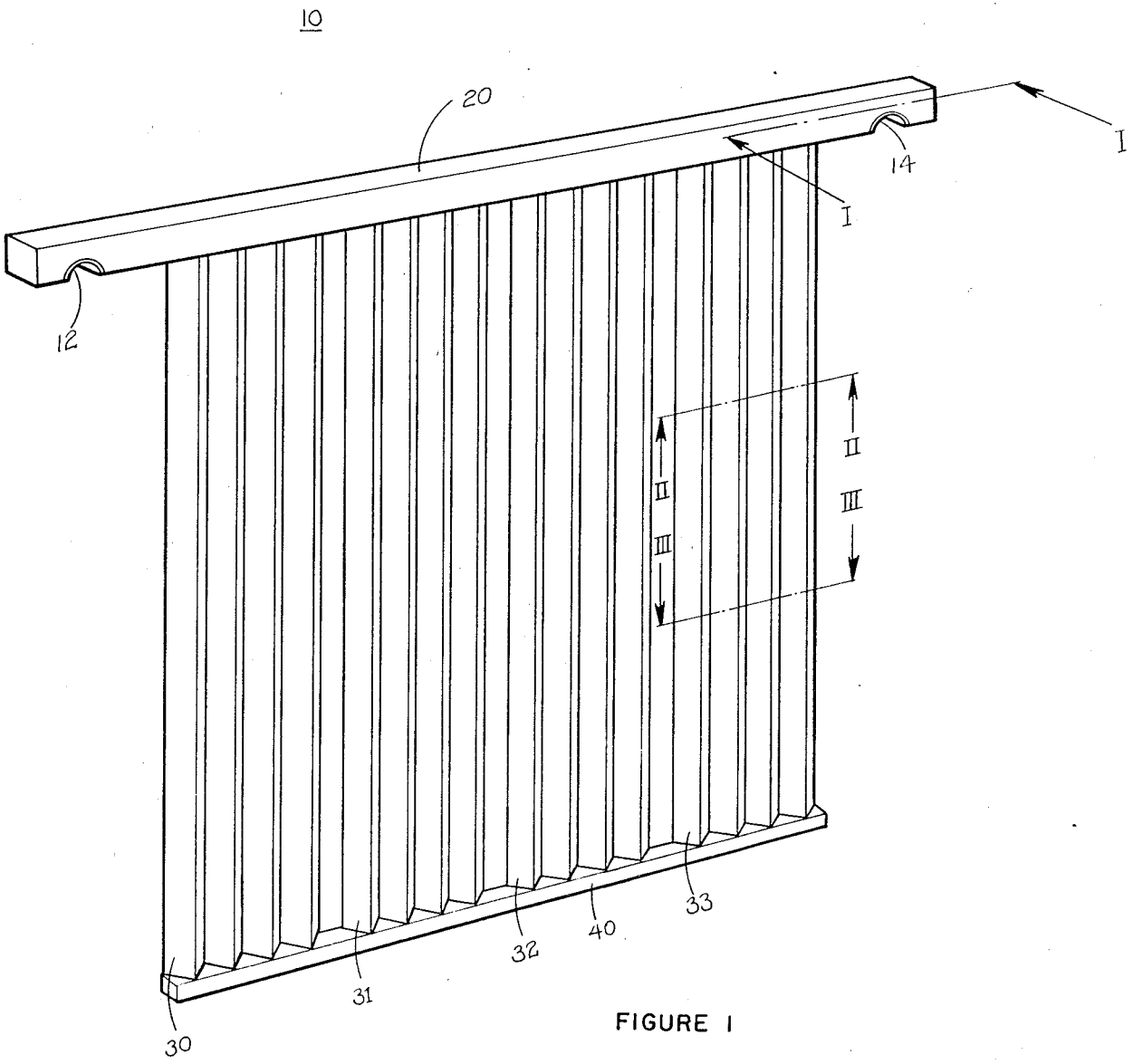
FIG. 1 is a perspective view of an electrode assembly in accordance with the present invention.
Figure 4:
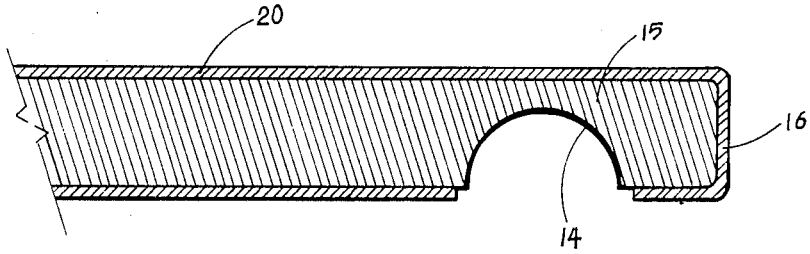
FIG. 4 is a sectional view of the electrode assembly of FIG. 1 taken along the line I—I.

Referring to FIG. 1, therein is illustrated an electrode assembly 10 in accordance with the present invention comprising a hanger bar member 20 having a longitudinal dimension, four corrugated panel members 30, 31, 32 and 33 and a stiffening bar member 40. As shown in FIG. 4, which is a section view of hanger bar member 20 taken along line I—I, hanger bar member 20 is comprised of a core 15 of an electrically conductive metal and a cladding 16 of a lesser electrically conductive and more corrosion resistant metal. Although, in FIG. 4, the cladding 16 of lesser electrically conductive and more corrosion resistant metal is illustrated as extending to and over one of the oppositely opposed ends of hanger bar member 20, said cladding 16 can terminate at said end leaving the core 15 of electrically conductive metal exposed. In a similar manner, the oppositely opposed end of hanger bar member 20 may comprise exposed metal core 15 of hanger bar member 20 only along the longitudinal dimension of said hanger bar member 20.

The metal comprising core 15 can be any metal suitable for the conductivity of an electrical current, including, for example, such metals as copper, aluminum and the like. The cladding 16, as illustrated in the sectional view of FIG. 4, is a lesser electrically conductive and more corrosion resistant metal and, in general, is a valve metal such as, for example, a metal selected from the group consisting of titanium, tantalum, niobium and the like, and alloys thereof. When an alloy is employed as the cladding 16, said alloy will contain as the predominant material therein one of the aforementioned valve metals.

Again referring to FIG. 1, said hanger bar member 20 is further characterized by a pair of engaging means comprising engaging means 12 and 14. Each of said engaging means 12 and 14 of said pair of engaging means is laterally disposed to the longitudinal dimension of said hanger bar member 20. Furthermore, each of said engaging means 12 and 14 of said pair of engaging means is spacially arranged inwardly from the opposite ends of said hanger bar 20.

With respect to the particular electrode assembly 10 illustrated in FIG. 1, each of said engaging means 12 and 14 of said pair of engaging means is a trough of semi-circular cross-section cut through said hanger bar member 20. During the forming of said trough type engaging means 12 and 14, the electrically conductive metal core 15 of said hanger bar member 20 is exposed. For at least one of engaging means 12 and 14 this metal core 15 is left exposed to permit intimate contact between said metal core 15 of hanger bar member 20 and a conventional current-carrying bus bar (not shown). Preferably, the lesser electrically conductive and more corrosion resistant metal cladding 16 on said hanger bar member 20 will be relieved around the edges of at least the engaging means of said pair of engaging means 12 and 14 intended for contact with the current-carrying bus bar. Such relief of the lesser electrically conductive and more corrosion resistant metal cladding 16 will further ensure the intimate contact between said metal core 15 of hanger bar member 20 and the current-carrying bus bar.

As disclosed herein, the electrode assembly of the present invention further comprises at least one corrugated panel member having oppositely opposed ends. In a preferred embodiment, the electrode assembly of the present invention will comprise two or more of these corrugated panel members, the electrode assembly 10 illustrated in FIG. 1, for example, comprising four of such corrugated panel members identified by the numbers 30, 31, 32 and 33, respectively. Each of said corrugated panel members 30, 31, 32 and 33 is formed from a single sheet of a lesser electrically conductive more corrosion resistant material such as, for example, titanium. These single sheets, generally, will have a thickness of less than about 0.16 inch (4.0 mm) and preferably less than about 0.08 inch (2.0 mm) or less. In addition to the preferred use of titanium sheet, the corrugated panel members 30, 31, 32 and 33 also can be formed from single sheets of other lesser electrically conductive and more corrosion resistant metals such as the valve metals tantalum, niobium and the like. Single sheets of alloys of titanium as well as the alloys of the other valve metals listed immediately above also can be used in producing the corrugated panel members 30, 31, 32 and 33 of the electrode assembly 10. For example, single sheets of titanium/manganese alloys containing 8%, 12% and 16% by weight of manganese, have been found useful in forming the corrugated panel members 30, 31, 32 and 33, respectively. Generally, however, the preferred valve metal for use in forming the corrugated panel members in electrode assembly 10 is titanium, and particularly preferred titanium metals are those corresponding to ASTM Grades 1–4, 7, 11 and 12.

Figure 2:
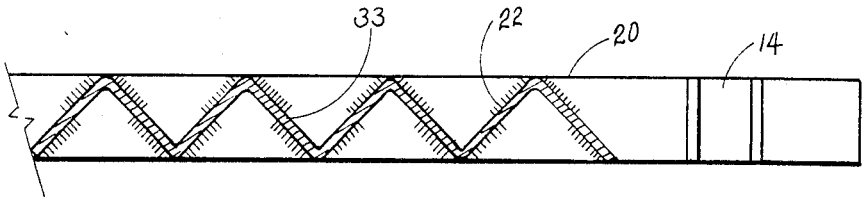
FIG. 2 is a sectional view of the electrode assembly of FIG. 1 taken along line II—II.
Figure 3:
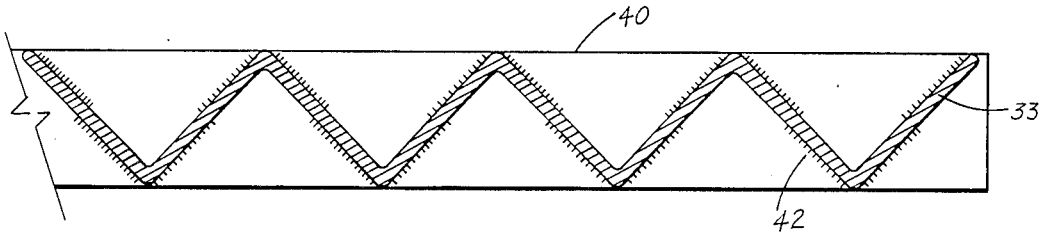
FIG. 3 is a sectional view of the electrode assembly of FIG. 1 taken along the line III—III.

The corrugated panel members 30, 31, 32 and 33 of electrode assembly 10 of this invention generally will be of a sinusoidal, trapezoidal or triangular shape or design. In addition to contributing to the overall stiffness of electrode assembly 10, such shapes or designs contribute to an increase in the effective surface area of these panel members 30, 31, 32 and 33. Although each of these shapes or designs work well for the use to which the electrode assembly 10 is intended, the triangular design illustrated in FIGS. 1, 2 and 3 for the corrugated panel members 30, 31, 32 and 33 provides the maximum effective surface area at the minimum cost.

Irrespective of the particular shape or design of the corrugation utilized for said corrugated panel members 30, 31, 32 and 33, it has been found that the effective surface area of said corrugated panel members as well as the overall stiffness of electrode assembly 10 are affected by certain dimensional relationships associated with said corrugations. In this regard, both the effective surface area of said corrugated panel members and said overall stiffness of the electrode assembly are affected by the dimensional ratio of the distance between the peaks or midpoints of adjacent corrugated sections to the amplitude of the peaks or midpoints of said corrugated sections. Thus, it has been found that as the above defined ratio approaches a value of about 2:1, said effective surface area and overall stiffness increases. Although the effective surface area of corrugated panel members 30, 31, 32 and 33 can be further improved by means disclosed hereinbelow, the overall stiffness of electrode assembly 10 appears to reach a maximum when the above ratio is established at a value of about 2:1.

Unexpectedly and for reasons unknown, the above described ratio also has been found to exert an effect on the quality of the deposit of desired product formed on said corrugated panel members 30, 31, 32 and 33 of electrode assembly 10. Thus, as this ratio approached the value of about 2:1 or was established at said value, it was found that the deposit formed on said corrugated panel members exhibited improved physical characteristics, including improved smoothness, uniformity of thickness, density and the like. Furthermore, it was found that dry cell batteries produced from these deposits exhibited electrochemical activities which increased in proportion with these improvements in the physical characteristics of the deposits.

The effective surface area of corrugated panel members 30, 31, 32 and 33 of electrode assembly 10 further can be increased and the passivation resistance thereof improved by providing the surfaces of said corrugated panel members with a multiplicity of minute indentations, i.e., hollows or pits. Such hollowing or pitting, i.e., roughening, of the surfaces of these corrugated panel members can be accomplished by known means such as, for example, by either chemical or mechanical treatment as disclosed in U.S. Pat. No. 3,436,323. Thus, the surfaces of the corrugated panel members 30, 31, 32 and 33 of electrode assembly 10 of the present invention can be roughened by either etching with a suitable etchant such as, for example, hydrochloric acid or by blasting with an abrasive material. Roughening of the surfaces of these corrugated panel members must be carefully controlled since the extent of the passivation resistance of said corrugated panel members is related to the regularity of the shape and size of the hollows and pits produced therein. In this regard, it was found that the passivation resistance of said corrugated panel members was particularly enhanced when the multitude of hollows or pits formed in the surfaces of the corrugated panel members were within a root mean square size of about 410±50 microinches. To achieve such regularity of the hollows and pits in the surface of corrugated panel members 30, 31, 32 and 33, the use of blasting techniques is preferred over chemical etching techniques. When employing blasting techniques to roughen the surfaces of said corrugated panel members, it also is preferred to employ an abrasive material which possesses a hardness and toughness sufficient to withstand the forces brought to bear upon it when in use. Representative, but nonlimiting, examples of abrasive materials having the requisite hardness and toughness and capable of providing a roughened surface of hollows and pits having root mean square sizes of 410±50 microinches include fused aluminum oxide, metal shot including angular grit, sintered bauxite and the like.

The passivation resistance of corrugated panel members 30, 31, 32 and 33 of electrode assembly 10 further can be enhanced by applying to the surfaces of said corrugated panel members an electrically conductive, electrolyte resistant film of a platinum group metal or metal oxide. Mixtures of said platinum group metals or metal oxides also can be applied to the surfaces of said corrugated panel members. Representative examples of said platinum group metals and metal oxides include platinum, ruthenium, palladium and the like and their corresponding oxides such as platinum oxide, ruthenium dioxide, palladium dioxide and the like. A particularly desirable passivation resistant film is that of ruthenium dioxide. A film of ruthenium dioxide readily can be applied to the surfaces of said corrugated panel members 30, 31, 32 and 33 by exposing said corrugated panal members to ruthenium hydroxychloride at temperatures of about 450° C. At such temperature, the ruthenium hydroxychloride decomposes to ruthenium dioxide which in turn is deposited on the surface of the corrugated panel members.

Corrugated panel members 30. 31, 32 and 33 are fixedly attached at their upper ends directly to hanger bar member 20 and along the longitudinal dimension of hanger bar member 20 and between said engaging means 12 and 14 by means of penetration welds. Such welds will be applied to both sides of said corrugated panel members 30, 31, 32 and 33 and along the exposed junctures or lines formed on both sides of said corrugated panel members where said corrugated panel members contact the surface of hanger bar member 20. Said penetration welds may constitute a series of continuous welds, i.e., welds of one-quarter inch length or greater, such as those illustrated in FIG. 2 as represented by weld 22, or may constitute a series of spot welds.

Referring once again to FIG. 1, electrode assembly 10 further comprises a stiffening bar member 40 having a longitudinal dimension. This stiffening bar member 40 is fixedly attached along its longitudinal dimension directly to the lower ends of corrugated panel members 30, 31, 32 and 33. Attachment of stiffening bar member 40 is effected in the same manner as attachment of the corrugated panel members 30, 31, 32 and 33 to hanger bar member 20, i.e., by the use of a series of continuous or spot penetration welds. The former illustrated in FIG. 3 and specifically represented by weld 42.

The stiffening bar member 40 generally will be a solid member constructed from the same lesser electrically conductive metal as corrugated panel member 30, 31, 32 and 33 and the coating 16 on hanger bar member 20. Thus, film-forming metals such as titanium. tantalum, niobium and alloys of these film-forming metals with other materials will be employed to construct stiffening bar member 40. Typical of the film-forming alloys that can be used in construction of stiffening bar member 40 are the various titanium-manganese alloys described hereinabove in which the manganese constitutes 8%, 12% and 16% by weight of the total weight of the alloy.

The electrode assemblies of the present invention, as exemplified by electrode assembly 10 illustrated in FIG. 1, have particular utility as anodes in electrolytic processes for the manufacture of battery grade manganese dioxide. In such processes, battery grade manganese dioxide is prepared by the electrolytic oxidation of acidic manganous sulfate electolyte solutions in a cell equipped, generally, with multiple cathodes and anodes. The passage of an electric current through this electrolyte and between the cathodes and anodes causes oxidation of the manganous sulfate at the anode and the deposition of a plate or coating of the desired manganese dioxide product on the anode. When this plate or coating has built up to the desired thickness, the anode bearing said plate or coating of manganese dioxide product then is removed from the cell and the plate or coating harvested therefrom. In general, such harvesting is accomplished by mechanical means such as, for example, flexing the anode to cause the manganese dioxide plate or coating to separate from the anode.

The electrode assemblies of the present invention provide a number of significant advantages over those currently being employed or proposed for use in electrolytic processes for the manufacture of battery grade manganese dioxide. For example, the herein described electrode assemblies permit the use of significantly thinner, single sheet, corrugated panel members on which the desired manganese dioxide can be deposited, i.e., corrugated panel members formed from sheet stocks having thicknesses of about 4 mm and and less. In general, the corrugated panel members forming a part of the electrode assemblies of the present invention can be formed from sheet stocks ranging in thickness from about 0.5 mm to about 4.0 mm. In a preferred embodiment, said corrugated panel members will be formed from sheet stocks ranging in thickness from about 1.0 to about 3.0 mm and most preferably from sheet stocks ranging from about 1.0 mm to about 2.0 mm in thickness. Furthermore, the ability to use single sheet corrugated panel members in these electrode assemblies avoids the problem of entrainment of cell electrolyte such as is encountered with electrode assemblies having panel members formed from flattened tubes or using corrugated panel members designed and constructed of two sheets fastened together (U.S. Pat. No. 4,319,977). Electrode assemblies having panel members formed from such flattened tubes or constructed of two sheets fastened together are characterized by open channels throughout the length of said panel members and in which channels cell electrolyte can be entrained as the oxide plate or coating builds up. Furthermore, the electrode assemblies of this invention exhibit improved deflection resistance (i.e., stiffness) which reduced the tendency of the electrode assembly to roll in the electrolytic cell, thereby reducing the possibility of contact between the electrode assembly and adjacent cathodes and the short circuits which can result from said contact. In addition, the improved deflection resistant characteristics of the electrode assemblies of this invention allow for easier removal of these electrode assemblies from the cell. Other advantages can be realized through the use of the electrode assemblies as described herein and defined in the appended claims.

While the invention herein has been described and illustrated in terms of what at present are believed to be the preferred embodiments, it is to be understood that this invention is not to be limited to the specific embodiments and that changes may be made thereto without departing from the spirit and scope thereof except as provided in the following claims.

What is claimed is:

1. An electrode assembly having improved dimensional stability consisting of:

a hanger bar member, said hanger bar member having a longitudinal dimension and oppositely opposed ends and comprised of a core of an electrically conductive metal and a coating on said core of a lesser electrically conductive valve metal, said hanger bar member having a pair of engaging means, each engaging means of said pair of engaging means being axially disposed to said longitudinal dimension of said hanger bar member and spacially arranged inwardly of said oppositely opposed ends thereof at least one of said engaging means of said pair of engaging means providing contact between said hanger bar member and an electric current-conducting bus bar;

at least one corrugated panel member having oppositely opposed upper and lower ends, said at least one corrugated panel member being formed from a single sheet of said lesser electrically conductive valve metal having a thickness of less than 4.0 mm and having corrugations characterized by a dimensional relationship of distance between peaks or midpoints of adjacent corrugations to the amplitude of the peaks or midpoints of said corrugations of about 2:1 said corrugated panel member being joined directly at its said upper end to the hanger bar member along the longitudinal dimension and between said engaging means thereof such that said at least one corrugated panel member extends perpendicular to said hanger bar member; and a stiffening bar member having a longitudinal dimension and joined directly to said lower end of said at least one corrugated panel member along said longitudinal dimension, said stiffening bar member being comprised of said lesser electrically conductive valve metal.

2. The electrode assembly of claim 1 wherein said hanger bar member comprises a core of electrically conductive copper and a coating thereon of lesser electrically conductive titanium metal.

3. The electrode assembly of claim 1 wherein said at least one corrugated panel members comprises at least one film forming metal selected from the group consisting of titanium, tantalum, niobium and alloys thereof.

4. The electrode assembly of claim 3 wherein said corrugted panel member is of a configuration selected from the group consisting of sinusoidal, trapezoidal and triangular configurations.

5. The electrode assembly of claim 3 wherein said at least one corrugated panel member has a surface containing a multiplicity of indentations having a root mean square size of about 410±50 microinches.

6. The electrode assembly of claim 1 wherein said film forming metal is titanium.

7. The electrode assembly of claim 1 wherein said stiffening bar member comprises at least one film forming metal selected from the group consisting of titanium, tantalum, niobium and alloys thereof.

8. The electrode assembly of claim 7 wherein said stiffening bar member is comprised of titanium.

* * * * *